US005630998A

United States Patent [19]

Parsons

[11] Patent Number: 5,630,998

[45] Date of Patent: May 20, 1997

[54] MOCK TRAINING BATON AND METHOD OF TRAINING LAW ENFORCEMENT PERSONNEL USING SAME

[75] Inventor: Kevin L. Parsons, Appleton, Wis.

[73] Assignee: Armament Systems and Procedures, Inc., Appleton, Wis.

[21] Appl. No.: 384,920

[22] Filed: Feb. 7, 1995

[51] Int. Cl.[6] ..... F41A 33/00; A63H 33/30

[52] U.S. Cl. ..... 434/11; 446/473; 482/83; 463/47.2; 463/47.6

[58] Field of Search ..... 434/11; 273/84 R, 273/67 R, DIG. 30; 446/473, 144; 482/83, 12

[56] References Cited

U.S. PATENT DOCUMENTS

| | | | |
|---|---|---|---|
| 2,676,804 | 4/1954 | Schultz | 273/84 |
| 4,149,723 | 4/1979 | Simon | 273/67 R |
| 4,892,303 | 1/1990 | Lohre | 446/473 X |
| 5,031,812 | 7/1991 | Gustine | 273/DIG. 30 |
| 5,295,926 | 3/1994 | Tanabe | 446/473 X |
| 5,324,227 | 6/1994 | Yuh-Ching | 446/473 |

FOREIGN PATENT DOCUMENTS

| | | | |
|---|---|---|---|
| 405215497 | 8/1993 | Japan | 273/84 R |

OTHER PUBLICATIONS

Black Belt (Magazine), "Simulate Actual Combat Situations With Rubber Weapons" (Advertisement), Martial Arts Supplies Company, Los Angeles CA, p. 29 May 1972.

*Primary Examiner*—Jeffrey A. Smith

*Attorney, Agent, or Firm*—Robert C. Curfiss; Mark A. Tidwell; Butler & Binion, L.L.P.

[57] ABSTRACT

A method of training in the use of law enforcement batons and a mock training baton for use in training exercises. The mock training baton includes a flexible rod covered by a cushioning material which is secured to the rod by a removable cover and may include a protective resilient disk at the ends of the rod and a means for securing the baton to the belt of trainee. The diameter, configuration and material of the handle of the mock training baton is identical to the handle of the actual standard issue baton. The mock baton may include a resilient ring for securing the cover to the baton and a fixed collar for anchoring the resilient disk in place. Alternatively, the mock baton may include a unique assembly for securing the handle to the rod.

48 Claims, 4 Drawing Sheets

6
40
38
30
34
42
39
8
8
32
36
55
54
44
41
49
52
50
46
7
7
48
35
38
34
32
46
38
34

MOCK TRAINING BATON AND METHOD OF TRAINING LAW ENFORCEMENT PERSONNEL USING SAME

BACKGROUND OF INVENTION

1. Field of Invention

The invention is generally related to a method and apparatus for training law enforcement personnel and is specifically directed to a mock baton for use in training exercises for law enforcement personnel.

2. Description of the Prior Art

One of the most important aspects of training law enforcement personnel is the proper handling and use of intermediate force weapons such as batons and the like. It is particularly important that law enforcement personnel be able to maneuver and handle the baton in a safe, but effective manner. In the past, police training programs have utilized training batons made from bamboo shredded into strips and covered with cloth. Bamboo was utilized to create a flexible baton which would be less likely to injure trainees who might be struck with the baton. More recently, police training programs have used hollow pipes, such as PVC pipes, covered with cushioning insulation or foam either taped or dip molded onto the pipe for training exercises.

While bamboo batons or cushioned pipes may be used during training exercises, prior art training batons have resulted in injuries. For example, a bamboo baton can be easily broken and may result in sharp dangerous splinters. Similarly, a pipe used as a training baton may break during training exercises. The sharp edges of a broken pipe may protrude through the cushioning material and cause severe cuts. Moreover, a rigid pipe when struck with the intensity used in training could cause serious injuries, such as broken bones.

While the use of actual batons in training is another option, the use of actual batons for training exercises is not desirable because such batons may be damaged if hit against another baton and, further, use of actual weapons substantially increases the risk of injury to the trainees. The use of actual batons in training programs can be costly in both equipment loss and personnel lost time due to accidents.

Another disadvantage of the prior art baton training methods is the short life of the available training batons. Often, repeated use will weaken the baton and cause it to break, which is particularly true of the bamboo and PVC batons. Even if the baton does not break, a weakened baton may not be suitable for use. For example, the foam used to cover pipes often deteriorates after repeated use and must be replaced to provide adequate protection during training exercises. However, in order to avoid accidental release, the foam on prior art batons is permanently secured to the pipe. Thus, the foam is not easily replaceable and the entire training baton usually must be replaced. While trainees can be instructed on the use of a baton without a training baton, the use of a baton similar to the actual baton during training exercises is desirable since the trainee becomes familiar with proper baton techniques and familiarity with the particular baton used by law enforcement personnel.

Therefore, there is a need to provide a durable, cost effective training baton for use by law enforcement trainees which includes a replaceable, cushioning envelope over the rod which protects the trainees from injury while allowing them to become familiar with the feel of the particular baton used by law enforcement personnel.

SUMMARY OF THE INVENTION

The subject invention is directed to a method of training in the use of law enforcement batons and to a mock baton for use in the training exercises. Basically, the baton of the subject invention is a flexible rod enveloped in a cushioning material which is held in place by a removable cloth cover and includes a handle attached to the rod. The diameter and configuration material of the baton handle is identical to the handle of the actual baton used by officers. The baton is specifically constructed to avoid breakage and permit easy replacement of the cushioning material as it wears or fatigues.

The invention includes two alternative preferred embodiments of the training baton: a straight training baton and a side handle training baton. The diameter, configuration and material of the handle in both embodiments is identical to the handle of the standard issue baton used by law enforcement personnel to provide the trainee with the feel of the actual baton during training exercises. Each of the embodiments includes a flexible rod covered by a cushioning material, such as standard foam-type heating and air conditioning insulation, for protecting an individual who might be hit with the baton from possible injury.

Both embodiments utilize a removable cloth cover which is placed over the foam to lock it in place. The cover is securely fastened to the baton yet is designed for easy removal to permit replacement of deteriorated insulation. Because standard insulation is used, protection is provided inexpensively with products that are easily replaceable in the field. The subject invention also includes a pad on the cover, a holder which is attached to the belt of the trainee and a complementary hook and loop type fastener on the pad and holder for releasably securing the training baton to the belt. In addition, the end of the rod in each embodiment carries a protective resilient disk that prevents the rod from being axially displaced relative to the insulation during a thrust, and possibly injuring a trainee.

In the first preferred embodiment, the handle of the baton is in axial alignment with the rod. The straight training baton includes a ring, preferably made of rubber, at the base of the rod adjacent to the handle. The purpose of the ring is to provide an anchor to hold the cloth cover in place. A resilient ring is preferred to minimize the likelihood of damage to the cover or possible injury to a trainee who might be hit with the baton during training exercises.

In order to protect trainees from possible injury, the rod is covered by the cushioning material, such as foam. The cover of the straight training baton embodiment is a hollow cloth sock or close-ended tube which is shaped to be fit snugly over the foam and secure it to the rod. The tube is closed at the outer end of the baton and includes an open end with a closure means, such as a drawstring, at the base of the rod adjacent to the handle. The open end is pulled over the resilient ring and closed to secure the cover to the rod. The cover is designed for easy removal to allow for replacement of deteriorated cushioning material without requiring replacement of the entire baton.

The straight training baton embodiment also includes a fixed collar for securing the rubber ring in place to assure that the ring is fixed and that the cover does not separate from the rod due to movement of the ring. If the cover is removed, the protective foam will not remain in place and the rod will be exposed, increasing the likelihood of injury. The collar is preferably made of a rigid material, such as aluminum, and is critical to keep the ring and the cover from pulling off under the stress of dynamic training. The collar is secured to the rod with screws placed at a ninety degree angle relative to another. If the collar were secured with screws placed at a 180 degree angle or via a diametric pin through the rod, this would create a stress line or weakness in the rod and may cause it to break during use. By placing the screws at an oblique angle, the stress line is eliminated and the rod is not weakened minimizing the possibility of breakage.

In the alternative embodiment, the handle of the baton extends radially outward from the rod. The side handle is secured to the rod by means such as welding, with a threaded insert on the base. The unique assembly of the rod and handle on the side handle training baton tightly secures the handle to the rod while allowing replaceable rods to be used. In this embodiment, a hollow shaft extends from the top of the handle and includes a hole through its side for receiving and positioning the rod perpendicular to the handle. A round disk with a center threaded opening may be welded or otherwise suitably secured to the top of the hollow shaft. The rod is inserted through the hole in the side of the tube and is held in position by a screw which is inserted into the threaded opening at the top of the shaft and placed in contact with the rod.

As in the straight baton embodiment, the side handle embodiment includes a cushioning material which surrounds the rod to protect an individual who might be hit with the baton from possible injury. The protective cushioning is secured to the rod by a cloth cover. In this embodiment, the cover is uniquely shaped to snugly fit a side handle baton and may utilize a hook and loop fastener, such as by way of example Velcro brand fastener or the like, for easy removal of the cover and replacement of deteriorated cushioning material.

The training baton of the subject invention provides a durable baton for use in training exercises for law enforcement personnel which includes a replaceable, inexpensive protective foam and is constructed to eliminate breakage and minimize possible injury while allowing trainees to become familiar with the proper baton techniques.

Therefore, it is an object and feature of the subject invention to provide a method of training in the use of law enforcement batons and to provide a mock baton to be used in the training exercises which allows trainees to become familiar with the proper baton techniques to be used on duty while minimizing the risk of possible injury.

It is also an object and feature of the subject invention to provide a training baton with a handle which is identical to the handle of the actual batons used by law enforcement personnel.

It is a further object and feature of the subject invention to provide a baton with a flexible rod enveloped by an inexpensive, replaceable cushioning material to prevent possible injury to an individual who might be hit with the baton.

It is yet another object and feature of the subject invention to provide a training baton with a removable hollow cover which tightly secures the cushioning material to the rod yet is easily removed for replacement of the material.

It is yet another object and feature of the subject invention to provide a training baton with a means for releasably securing the baton to the belt of an officer for carrying the baton when not in use.

It is a further object and feature of the subject invention to provide a straight training baton including a handle which is in axially alignment with the rod and a removable cover secured to the rod by a resilient ring which is uniquely anchored by a fixed collar.

It is also an object and feature of the subject invention to provide a side handle training baton including a handle which extends radially outward from the rod and a unique handle assembly which allows the rod to be easily replaced.

Other objects and features will be readily apparent from the accompanying drawings and description.

DETAILED DESCRIPTION OF THE DRAWINGS

The mock training batons of the subject invention and the training method utilizing the mock batons are unique in that the handle of each baton is designed to be identical to the handle of a standard issue baton. Because the diameter and configuration material of the mock baton handle is identical to the handle of the actual baton, the trainee becomes familiar with handling a baton similar to the actual baton during trainee exercises. Thus, utilizing the mock baton during training exercises maximizes the ability of law enforcement personnel to be trained in the safe manual handling and manipulation of the actual standard issue baton.

Figure 1:
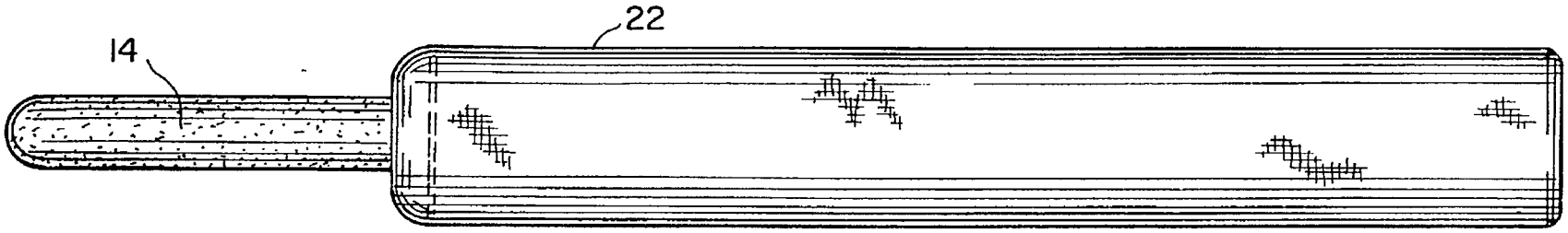
FIG. 1 is a perspective view of the straight training baton embodiment of the subject invention.
Figure 3:
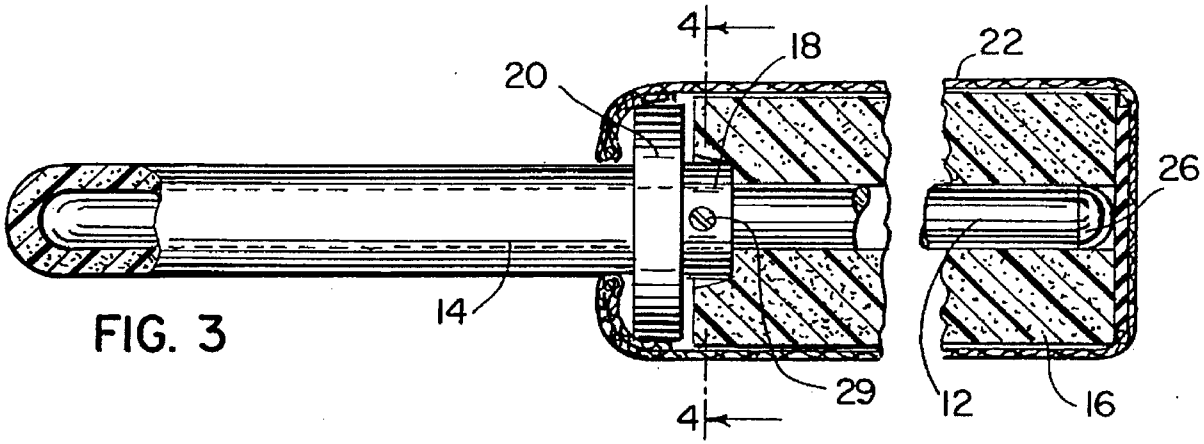
FIG. 3 is an enlarged cross-sectional view of the straight training baton showing the cover held in place by the resilient disk and fixed collar and encompassing the foam covering and rod.
Figure 2:
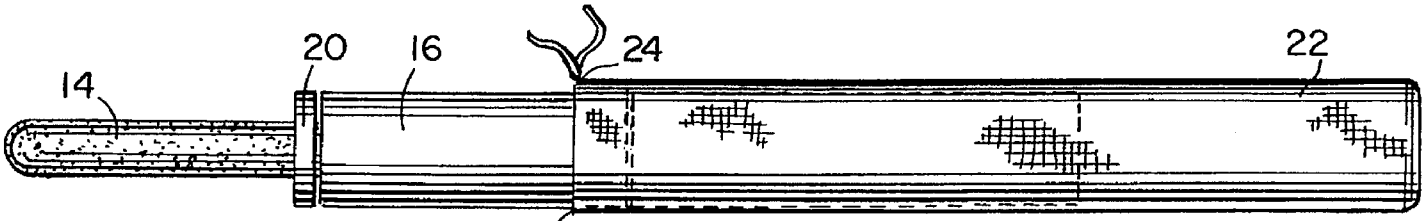
FIG. 2 is a perspective view of the straight training baton with the cover partially removed exposing the foam covering and resilient disk adjacent to the handle.
Figures 5, 6, 7, 8, 9:
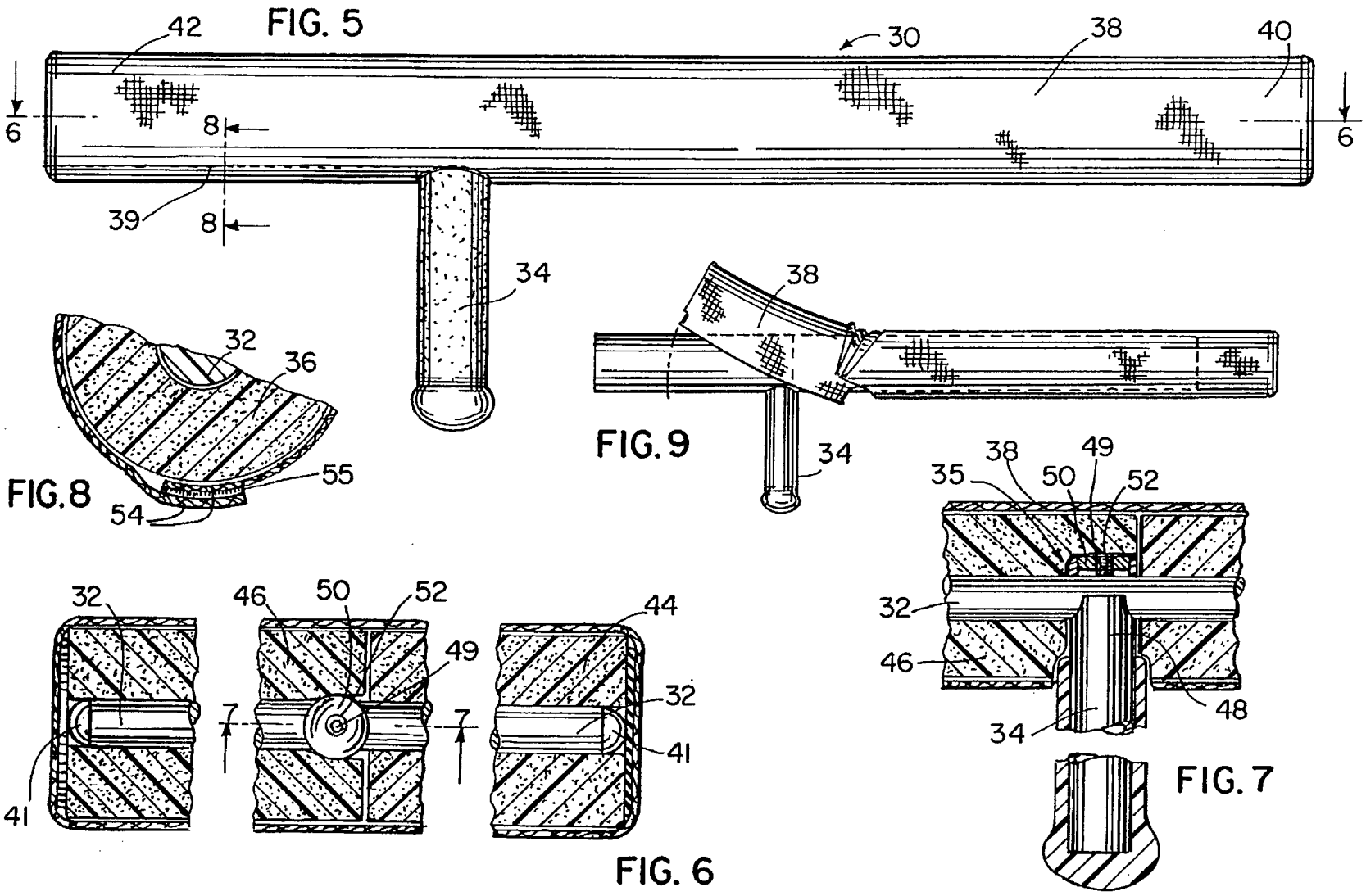
FIG. 5 is a perspective view of the side handle training baton embodiment of the subject invention.
FIG. 6 is a cross-sectional overhead view of the intersection where the handle extends radially outward from the rod, showing the foam surrounding the intersection and the cloth covering.
FIG. 7 is an enlarged cross-sectional view taken along line 7—7 of FIG. 6 showing the unique weld assembly securing the handle to the rod.
FIG. 8 is a partial cross-sectional view of the overlapping edges of the cloth cover which are secured to the rod by a hook and loop type fastener.
FIG. 9 is a perspective view of the side handle training baton with the cover partially removed.

The two alternative embodiments of the mock training baton of the subject invention are generally shown in FIG. 1 (straight training baton) and FIG. 5 (side handle training baton). As shown in FIGS. 1–3, the straight training baton 10 of the subject invention generally comprises a flexible rod 12, a handle 14 in axial alignment with the rod, a cushioning material 16, such as foam, enveloping the rod, a fixed collar 18, a resilient ring 20 and a removable cover 22. In the preferred embodiment, the rod 12 is constructed from flexible plastic and is lighter in weight than the actual standard issue baton. Also, because there is cushioning material enveloping the rod, it may be desirable to make the rod 12 slightly shorter than an actual baton rod. As shown in FIG. 1, the handle 14 is in axial alignment with the rod 12 and is identical to the handle of the actual standard issue baton. The inclusion of a handle which is identical to the handle of the actual baton to be used by law enforcement personnel is a unique feature of the both embodiments of the mock training baton.

Because the rod 12 is flexible, it gives. This give, in combination with the cushioning material 16, protects the trainee from possible injury. The cushioning material 16 is preferably standard heating and air conditioning insulation and is wrapped around the rod 12. The use of standard insulation provides an easily replaceable, inexpensive way to protect an individual who might be hit with the baton from possible injury. In addition, a protective resilient disk 26 may be included at the end of the rod 12, as shown in FIG. 3, to prevent the rod from being axially displaced relative to the cushioning material 16 during a thrust and possibly injuring a trainee.

The mock baton 10 of the subject invention includes a removable, tube-shaped cover 22 which is adapted to fit snugly over the cushioning material 16 and secure it to the rod 12. The removable cover 22 is preferably made of a cloth material. As shown in FIG. 2, the cover 22 is open at one end 23 for easy removal which allows the cushioning material 16 to be replaced without requiring replacement of the mock baton 10.

Figure 10:
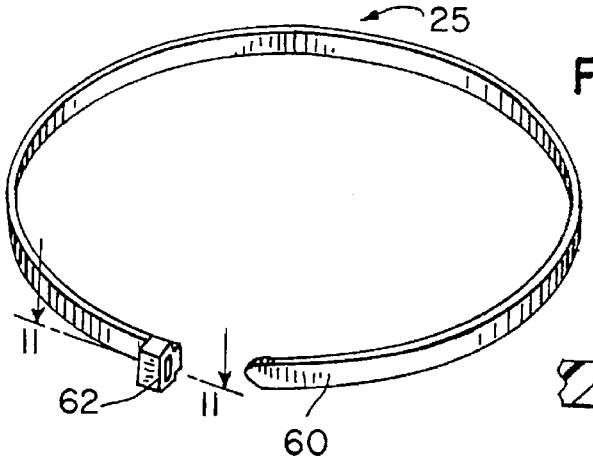
FIG. 10 is a perspective view of a drawstring used to close the open end of the cover and secure the cover to the rod.
Figure 11:
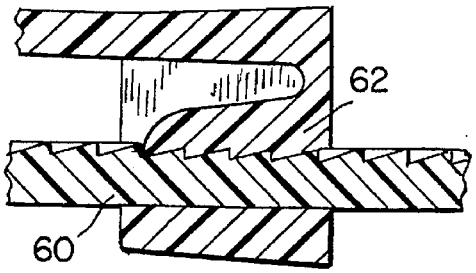
FIG. 11 is an enlarged cross-sectional view taken along line 11—11 of FIG. 10 showing a saw-tooth surface of the drawstring pulled through an opening to lock the drawstring in a tight loop.
Figure 12:
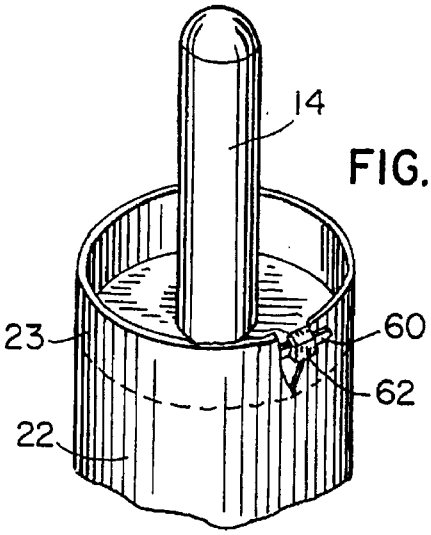
FIG. 12 is a perspective view of the open end of the cover with the drawstring in the open position.
Figure 14:
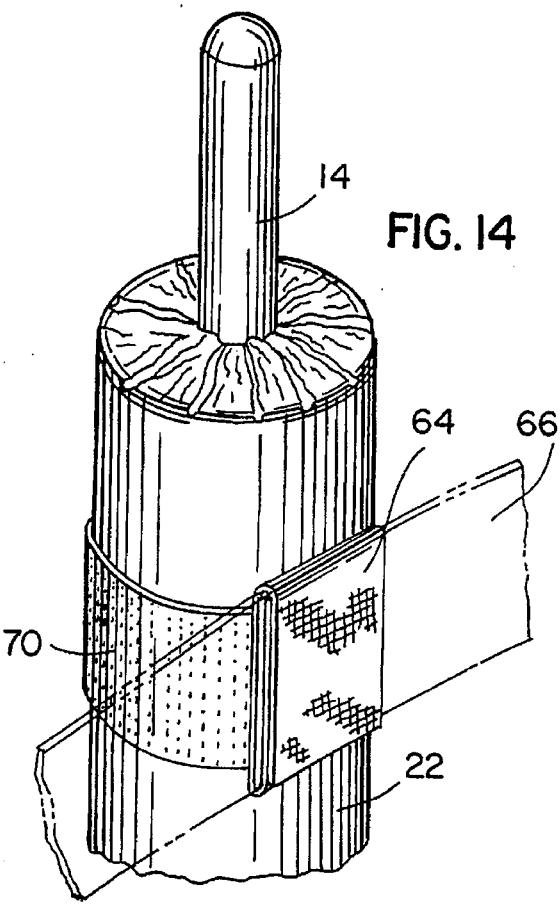
FIG. 14 is a perspective view of a means for releasably securing the baton to a belt (shown in phantom) of a law enforcement officer.
Figure 13:
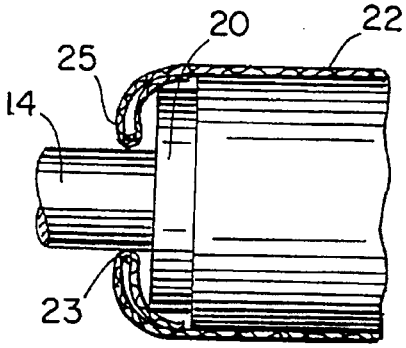
FIG. 13 is a cross-sectional view of the open end of the cover tightly secured around the handle of the baton when the drawstring is closed.

The cover 22 includes a means for closing the open end 23 about the rod to hold the cushioning material and cover in place. In the preferred embodiment, the drawstring 24 is a plastic tie, such as an electrical tie 25 and is enclosed within the open end of the cover 22 (see FIG. 12). As shown in FIGS. 10 and 11, the tie 25 has opposite ends 60 and 62, wherein one end 60 includes a saw-tooth surface and the other end 62 includes a receiving opening with a wedge which extends into the opening and engages with the saw-tooth surface. As shown in FIGS. 13 and 14, when the end 60 is pulled through the opening 62, the electrical tie 25 is locked in a tight loop around the handle 14 for securing the cover 22 in place. Although a drawstring 24 or sawtooth tie 25 is shown, any suitable means for closing the open end 23 may be used.

In the preferred embodiment, the straight training baton 10 includes a resilient ring 20 located at the base of the rod 12 adjacent to the handle 14. The resilient ring 20 is preferably made of rubber to minimize the likelihood of damage to the cover 22 or possible injury to a trainee who might be hit with the baton 10 during training exercises. The purpose of the ring 20 is to provide an anchor to hold the cloth cover 22 in place during training exercises. As shown in FIG. 3, the open end 23 of the cover 22 is pulled over the ring 20 and drawn into a tight loop around the handle 14 thereby securing the cover 22 in place.

Figure 4:
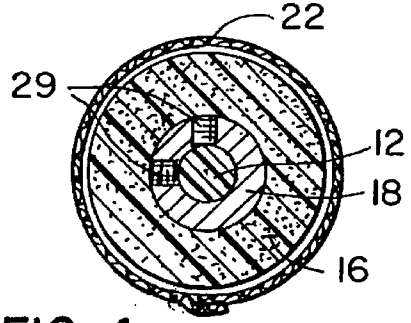
FIG. 4 is a cross-sectional view taken along line 4—4 of FIG. 3 showing the angled position of the screws securing the collar to the rod.

The ring 20 is secured in place by a fixed collar 18. Without the collar 18 to hold the ring 20 in place, the cover 22 and ring 20 may be torn off under the stress of dynamic training. If the cover 22 is torn off, the protective cushioning material 16 will fall off and a trainee may be injured by the exposed rod 12. As shown in FIG. 3, the collar is positioned on the rod 12 adjacent to the ring 20 which is adjacent to the handle 14. A unique feature of the subject invention is the placement of the screws at an oblique angle to avoid weakness created by placing the screws at a 180 degree angle, as is typical, or inserting a roll pin through the rod. In the preferred embodiment, the collar 18 is secured to the rod 12 with screws 29 placed at a ninety degree angle. (See FIG. 4). By placing the screws 29 at a ninety degree angle, the mock baton 10 of the subject invention avoids creating weakness in the rod and eliminates the possibility of breakage.

Figure 15:
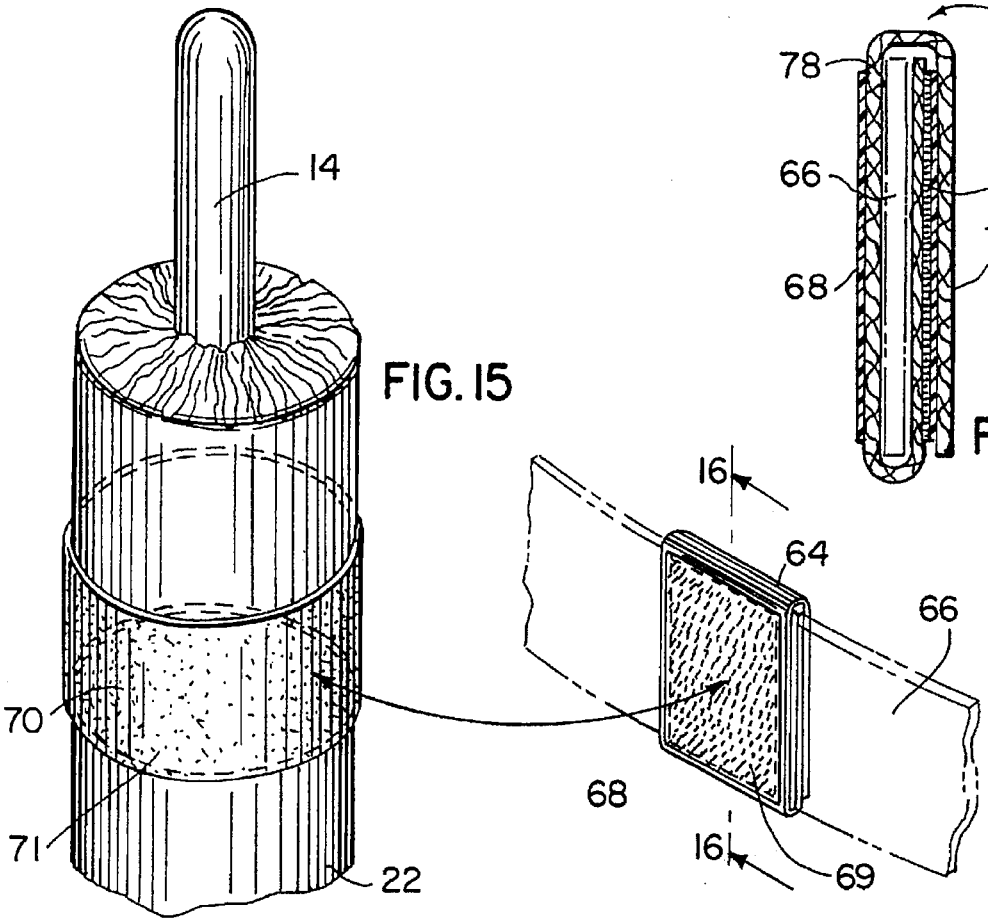
FIG. 15 is a perspective view of the holder including a first pad and the cover including a complementary second pad encircling the cover for engaging the first pad and securing the baton to the holder.

In the preferred embodiment, the training baton includes a means for releasably securing the baton to a belt of a law enforcement officer when the baton is not in use in much the same manner as a scabbard might be used. As shown in FIGS. 14 and 15, a holder 64 is attached to the belt 66 and includes a first pad 68 which faces outward and a second pad 70 on the cover 22 which forms a ring around the lower portion of the rod 12 (See FIG. 3). The first and second pads include a complementary hook and loop fastener for releasably securing the baton to the holder 64. As shown in FIG. 15, the first pad 68 on the holder 64 includes a plurality of projecting hooks 69 and the second pad 70 on the cover 22 includes a plurality of projecting closed loops 71. Because the plurality of projecting hooks 69 forms a rough, abrasive surface which may scratch or cause injury to a trainee struck by the baton, it is preferred that the softer surface formed by the plurality of projecting closed loops 71 always be included on the cover 22 of the baton rather than vice versa.

Figure 16:
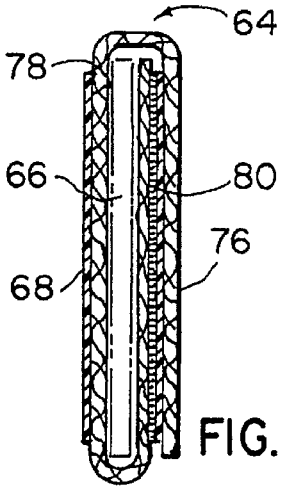
FIG. 16 is a cross-sectional view taken along line 16—16 of FIG. 15 showing how the holder is tri-folded to form a loop around the belt with the first pad facing outward to engage the second pad.
Figure 17:
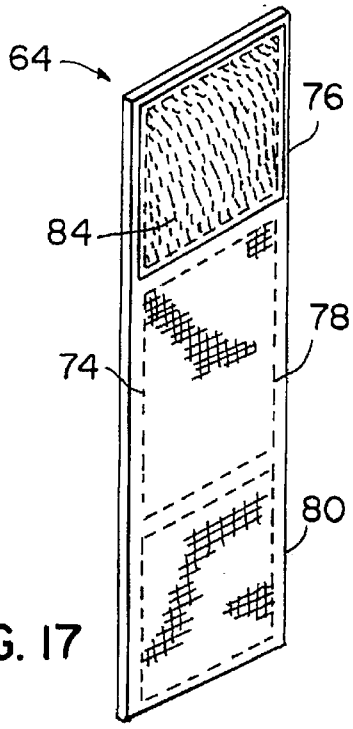
FIG. 17 is a perspective view of the back side of the holder which is adapted to be tri-folded and includes a first section of projecting hooks.
Figure 18:
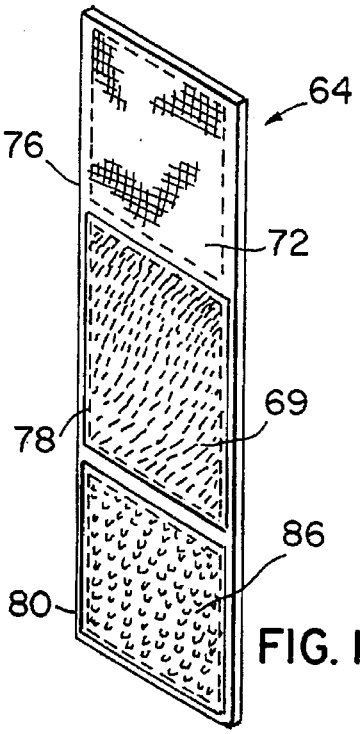
FIG. 18 is a perspective view of the front side of the holder including the first pad located in the middle section and a third section of projecting closed loops.

In the preferred embodiment, the holder 64 is an elongated strip which is adapted to be tri-folded to form a loop around the belt 66 for securing the holder to the belt. As shown in FIGS. 17 and 18, the holder 64 includes a front side 72 and a back side 74 and is divided into three sections, a first section 76, a middle section 78 and a third section 80. The first and third sections 76, 80 are folded inward to form the loop around the belt 66 and include a fastener 82 for securing the strip into the loop (see FIG. 16).

In the preferred embodiment, the fastener 82 is a complementary hook and loop fastener where the back side 74 of the first section 76 includes a plurality of projecting hooks 84 and the front side 72 of the third section 80 includes a plurality of projecting closed loops 86. Thus, the third section 80 is folded inward over the middle section 78 and the first section 76 is folded inward over the third section 80 so that the loops 86 of the third section 80 receive the hooks 84 of the first section and fasten the strip into the loop around the belt (see FIG. 16). The middle section 78 on the front side of the strip includes the first pad 68 and the plurality of projecting hooks 69. When the holder 64 is looped around the belt, the middle section 78 faces outward ready to fasten the baton to the holder when the hooks 69 of the first pad 68 and the loops 71 of the second pad 70 on the cover of the baton are engaged.

The side handle training baton of the alternative embodiment is shown in FIGS. 5–9. The side handle training baton 30 is designed to be similar to the standard issue side handle baton. The side handle baton 30 generally comprises a flexible rod 32, a handle 34 extending radially outward from the rod, a cushioning material 36 enveloping the rod and a removable cover 38. In the preferred embodiment, the rod 32 is made from a flexible plastic and is similar in length to the rod of the actual standard issue baton. The rod 32 has opposite ends, a striking end 40 and a back end 42 and may include a protective resilient disk 41 at each end of the rod for preventing the rod from being axially displace relative to the cushioning material 36 during a thrust and possible injuring a trainee.

The handle 34 is secured to the rod by a unique, inexpensive weld assembly 35 with a threaded insert which eliminates the possibility that the rod will accidently disengage from the rod. In the preferred embodiment, a hollow shaft 48 extends from the top portion of the handle 34. The hollow shaft 48 includes a through hole in its side for receiving and positioning the rod 32 perpendicular to the handle 34. The rod 32 is inserted through the hollow shaft so that the handle 34 extends radially outward from a position near the back end 42 of the rod 32. A round disk 50 with a center threaded opening 52 is welded to the top of the hollow shaft 48. (See FIG. 6). As shown in FIG. 7, a screw 49 is inserted into the threaded opening 52 and placed in contact with the rod 32 to secure the rod 32 in place. While the rod is locked in place during training exercises, the unique weld assembly allows the rod 32 to be easily removed from the handle 34 where necessary by threadably removing the screw 49.

The cushioning material 36 is a foam, such as standard heating and air conditioning insulation, and is wrapped around the flexible rod 32. The combination of the flexible rod 32 surrounded by the cushioning material 36 protects trainees from possible injury. The cushioning material 32 is formed from two pieces of insulation. The first piece 44 covers the portion of the rod 32 from the handle 34 to the striking end 40 and the second piece 46 covers the portion of the rod from the handle to the back end 42, including the unique weld assembly securing the handle to the rod and the top portion of the handle.

As in the first preferred embodiment, the cushioning material 36 is secured to the rod 32 by a removable, tube-shaped cover 38. The cover 38 has two closed ends and is uniquely shaped to snugly fit the side handle baton 30. As shown in FIG. 9, the cover 38 may be removed and includes a means for closing the cover to secure it to the baton and for removing the cover to allow for replacement of the cushioning material 36. In the preferred embodiment, a portion 39 of the cover 38, extending from the handle 34 to the back end 42 of the rod, includes overlapping ends 54 having a hook and loop fastening type system 55, such as Velcro, for easy removal of the cover 38. (See FIG. 8).

While specific embodiments and features of the invention have been disclosed herein, it will be readily understood that the invention encompasses all enhancements and modifications within the scope and spirit of the following claims.

What is claimed is:

1. A method for training law enforcement personnel trainees in the proper use of a specific, standard issue baton, the method comprising the steps of:

a. providing to a trainee a mock baton, said mock baton comprising a flexible rod having a tip end, a handle and a cushioning, replaceable material forming an envelope over the rod to protect against injury, said handle being substantially identical to the standard issue baton handle;

b. instructing a trainee to utilize the mock baton in training exercises for maximizing the ability of law enforcement personnel in the safe manual handling and manipulation, of the actual standard issue baton;

c. having a trainee perform the training exercises; and d. replacing the mock baton with the standard issue baton after a predetermined level of skill in the manual handling of the mock baton has been achieved.

2. The method of claim 1, the providing step further comprising:

a. said mock baton further comprising a removable cover fitted over the cushioning material and the rod and including a means for tightly securing the cover to the rod; and b. a resilient disk placed at the tip end of the rod for preventing the rod from disengaging from the cushioning material and the cover during a thrust and injuring a trainee.

3. The method of claim 1, the providing step further comprising:

a. attaching the handle to the rod in a position which is in axial alignment with the rod;

b. positioning a resilient ring on the rod adjacent to the handle;

c. positioning a fixed collar on the rod adjacent to the ring, said collar having a central opening for inserting the rod through the collar and wherein the means for securing the collar to the rod does not create a structural weakness in the rod;

d. fitting a removable cover over the cushioning material and the rod, said removable cover having an open and a closed end and including a closing means for securing the open end of the cover around the resilient ring for tightly securing the cover to the rod; and e. placing a resilient disk at the tip end of the rod for preventing the rod from disengaging from the cushioning material and the cover during a thrust and injuring a trainee.

4. The method of claim 3, the providing step further comprising:

a. designating two openings on the collar which intersect the axis of the rod at an oblique angle;

b. inserting two holders into the openings, said holders adapted to be inserted into the openings for securing the collar to the rod.

5. The method of claim 1, the providing step further comprising:

a. utilizing a weld assembly to attach the handle to the rod in a position which extends radially outward from the rod, said rod having opposite ends;

b. fitting a removable cover over the cushioning material and the rod, said cover including a closing means for tightly securing the cover to the rod; and c. placing a resilient disk at each end of the rod for preventing the rod from disengaging from the cushioning material and the cover and injuring a trainee.

6. The method of claim 5, the providing step further comprising:

a. designating in the weld assembly, an upper section extending upward from the handle, said upper section having a top and including a through hole for receiving the rod in a position perpendicular to the handle;

b. welding a round disk to the top of the upper section, said disk having a center opening including a threaded inner surface adapted to receive a holder; and c. securing the rod to the upper section of the handle by inserting the holder into the opening.

7. A mock baton for use in training exercises for law enforcement personnel in the use of a specific standard issue baton, the mock baton comprising:

a. a flexible rod having a tip end and a handle for gripping the rod;

b. a cushioning material forming an envelope over the rod, said material being replaceable;

c. a removable cover encompassing the cushioning material and the rod and including a means for tightly securing the cover to the rod; and d. a resilient disk at the tip end of the rod for preventing the rod from disengaging from the cushioning material and the cover during a thrust and injuring a trainee.

8. The mock baton of claim 7, further comprising a means for releasably securing the baton to a belt worn by a law enforcement officer for carrying the baton when not in use.

9. The mock baton of claim 8, the means comprising a holder attached to the belt including a first pad and the cover of the baton including a second pad, said first and second pads including a complementary hook and loop fastener for releasably securing the baton to the holder.

10. The mock baton of claim 9, wherein the first pad includes a plurality of projecting hooks and the second pad includes a plurality of closed loops adapted to receive the projecting hooks for releasably securing the two pads together.

11. The mock baton of claim 10, wherein the rod has an upper portion and a lower portion near the handle, said second pad being secured to the cover and encircling the lower portion of the rod for releasably securing the baton to the first pad.

12. The mock baton of claim 11, the holder further comprising an elongated, tri-folding strip including a fastener and adapted to be looped around and fastened to the belt so that the first pad faces outward for releasably securing the baton to the holder.

13. The mock baton of claim 12, wherein the fastener is a complementary hook and loop fastener.

14. The mock baton of claim 13, wherein the elongated strip has a front side and a back side, both sides being divided into a first, middle and third section, said first section on the back side including a plurality of projecting hooks, said third section on the front side including a plurality of projecting closed loops for receiving the hooks when the strip is tri-folded, and said middle section on the front side comprising the first pad.

15. The mock baton of claim 11, wherein said removable cover is a cloth material.

16. The mock baton of claim 9, wherein said cushioning material is foam.

17. The mock baton of claim 16, wherein said foam is standard heating and air conditioning insulation.

18. The mock baton of claim 8, wherein said handle is identical to the handle of the specific standard issue baton.

19. The mock baton of claim 7, wherein said rod is a flexible plastic.

20. A mock baton for use in training exercises for law enforcement personnel in the use of a specific standard issue baton, the mock baton comprising:

a. a flexible rod having an axis, a tip end and a handle for gripping the rod, said handle being axially in alignment with the rod;

b. a cushioning material forming an envelope over the rod, said material being replaceable;

c. a resilient ring positioned on the rod adjacent to the handle;

d. a fixed collar for securing the ring in place, said collar having a central opening for inserting the rod through the collar and means for securing the collar to the rod, wherein the means for securing the collar to the rod does not create a structural weakness in the rod;

e. a removable cover having an open and a closed end, said cover encompassing the envelope and rod and including a closing means for securing the open end of the cover around the resilient ring for tightly securing the cover to the rod; and f. a resilient disk at the tip end of the rod for preventing the rod from disengaging from the envelope and the cover during a thrust and injuring a trainee.

21. The mock baton of claim 20, wherein the cushioning material is foam.

22. The mock baton of claim 21, wherein said foam is standard insulation.

23. The mock baton of claim 22, said collar further including two openings intersecting the axis of the rod at an oblique angle and two holders adapted to be inserted into the openings for securing the collar to the rod.

24. The mock baton of claim 23, wherein said holders are placed at a ninety degree angle relative to one another.

25. The mock baton of claim 24, wherein said holders are screws.

26. The mock baton of claim 25, wherein the resilient ring is rubber.

27. The mock baton of claim 26, wherein said closing means comprises a drawstring.

28. The mock baton of claim 26, wherein said closing means for securing the cover to the rod is a tie which is drawn into a tight loop below the ring, said tie having a first and second end, said first end including an opening with a wedge extending into the opening and said second end including a saw tooth surface.

29. The mock baton of claim 28, wherein the second end is inserted into the opening of the first end whereby the saw tooth surface engages with the wedge to secure the tie in the loop.

30. The mock baton of claim 29, wherein said rod is a flexible plastic.

31. The mock baton of claim 30, wherein said handle is identical to the handle of the specific standard issue baton.

32. The mock baton of claim 31, wherein said removable cover is a cloth material.

33. A mock baton for use in training exercises for law enforcement personnel in the use of a specific standard issue baton, the mock baton comprising:

a. a flexible rod having opposite ends and a handle for gripping the rod, said handle extending radially outward from the rod;

b. an assembly for securing the handle to the rod, said assembly permitting replacement of the rod;

c. a cushioning material forming an envelope over the rod, said material being replaceable;

d. a removable cover adapted to encompass the cushioning material and the rod, said cover including a closing means for tightly securing the cover to the rod; and e. a resilient disk at each end of the rod for preventing the rod from disengaging from the envelope and the cover during a thrust and injuring a trainee.

34. The mock baton of claim 33, said assembly further comprising:

a. an upper section extending upward from the handle, said upper section having a top and including a through hole for receiving the rod in a position perpendicular to the handle;

b. a round disk having a center opening including a threaded inner surface adapted to receive a holder, said disk being welded to the top of the upper section; and c. wherein said rod is secured to the upper section of the handle by inserting the holder into the opening.

35. The mock baton of claim 34, wherein said holder is a screw.

36. The mock baton of claim 35, wherein said assembly is located near one end of the rod whereby said handle extends radially outward from near said end of the rod.

37. The mock baton of claim 36, wherein said closing means comprises a first fastening element having plurality of projecting closed loops and a second fastening element have a plurality of projecting hooks adapted to be received in the loops thereby fastening the cover over the cushioning material and the rod.

38. The mock baton of claim 37, wherein said rod is a flexible plastic.

39. The mock baton of claim 38, wherein said handle is identical to the handle of the specific standard issue baton.

40. The mock baton of claim 39, wherein said cushioning material is foam.

41. The mock baton of claim 40, wherein said foam is standard insulation.

42. The mock baton of claim 41, wherein said removable cover is a cloth material.

43. A mock baton for use in training exercises for law enforcement personnel in the use of a specific standard issue baton, the mock baton attachable to a belt worn by a law enforcement officer, the mock baton comprising a rod, a handle, a cover disposed over said rod and a means for releasably securing the baton to the belt, said means for securing further comprising a holder for releasable attachment to the belt, said holder including a first pad, and said cover of the baton including a second pad, said first and second pads including a complementary hook and loop fastener for releasably securing the baton to the holder.

44. The mock baton of claim 43, wherein the first pad includes a plurality of projecting hooks and the second pad includes a plurality of closed loops adapted to receive the projecting hooks for releasably securing the two pads together.

45. The mock baton of claim 44, wherein the rod has an upper portion and a lower portion near the handle, said second pad being secured to the cover and encircling the lower portion of the rod for releasably securing the baton to the first pad.

46. The mock baton of claim 45, the holder further comprising an elongated, tri-folding strip including a fastener and adapted to be looped around and fastened to the belt so that the first pad faces outward for releasably securing the baton to the holder.

47. The mock baton of claim 46, wherein the fastener is a complementary hook and loop fastener.

48. The mock baton of claim 47, wherein the elongated strip has a front side and a back side, both sides being divided into a first, middle and third section, said first section on the back side including a plurality of projecting hooks, said third section on the front side including a plurality of projecting closed loops for receiving the hooks when the strip is tri-folded, and said middle section on the front side comprising the first pad.

* * * * *